US008746208B2

(12) United States Patent
Möller

(10) Patent No.: US 8,746,208 B2
(45) Date of Patent: Jun. 10, 2014

(54) INTERNAL COMBUSTION ENGINE HAVING AT LEAST ONE COMBUSTION CHAMBER

(75) Inventor: Heribert Möller, Sachsen (DE)

(73) Assignee: MAN Truck & Bus AG, Munich (DE)

( * ) Notice: Subject to any disclaimer, the term of this patent is extended or adjusted under 35 U.S.C. 154(b) by 155 days.

(21) Appl. No.: 13/462,142

(22) Filed: May 2, 2012

(65) Prior Publication Data

US 2012/0279463 A1 Nov. 8, 2012

(30) Foreign Application Priority Data

May 4, 2011 (DE) ..... 10 2011 100 324
Nov. 15, 2011 (DE) ..... 10 2011 118 537

(51) Int. Cl.
*F01L 13/06* (2006.01)

(52) U.S. Cl.
USPC ..... 123/320; 123/90.16

(58) Field of Classification Search
USPC ..... 123/90.12, 90.15, 90.16, 90.22, 90.23, 123/90.39, 320, 321
See application file for complete search history.

(56) References Cited

U.S. PATENT DOCUMENTS 2,036,936 A 4/1936 Halford
5,107,803 A * 4/1992 Furnivall ..... 123/90.16
5,890,469 A 4/1999 Hakansson et al.
6,394,050 B1 5/2002 McCarthy et al.
7,673,600 B2 * 3/2010 Yang ..... 123/90.16
7,913,656 B2 * 3/2011 Magnan et al. ..... 123/90.16
8,161,936 B2 * 4/2012 Kraft et al. ..... 123/321
8,225,769 B2 7/2012 Dilly
8,240,288 B2 * 8/2012 Dilly ..... 123/321
2007/0144472 A1 6/2007 Yang
2010/0319657 A1 12/2010 Dodi et al.

FOREIGN PATENT DOCUMENTS

EP 2143896 A1 1/2010
EP 2305968 A1 4/2011
WO 9629508 A1 9/1996
WO 2010141633 A1 12/2010

* cited by examiner

*Primary Examiner* — Thomas Denion
*Assistant Examiner* — Daniel Bernstein
(74) *Attorney, Agent, or Firm* — Laurence A. Greenberg; Werner H. Stemer; Ralph E. Locher

(57) ABSTRACT

An internal combustion engine has a combustion chamber, from which exhaust gas can be discharged by way of at least one exhaust valve. An engine braking device includes an hydraulic additional valve control unit is integrated into a connecting mechanism connecting the exhaust valve to a camshaft and holding the exhaust valve in a partially opened position when the engine brake is actuated. The connecting mechanism includes a rocker lever and an intermediate element between the rocker lever and the exhaust valve. The hydraulic additional valve control unit of the engine braking device has a first piston-cylinder unit for the temporary partial opening of one exhaust valve, and an hydraulic valve lash compensating mechanism has a second piston-cylinder unit for counteracting valve lash. The first piston-cylinder unit is arranged in or on the intermediate element. The second piston-cylinder unit is arranged in or on the rocker lever.

16 Claims, 10 Drawing Sheets

INTERNAL COMBUSTION ENGINE HAVING AT LEAST ONE COMBUSTION CHAMBER

CROSS-REFERENCE TO RELATED APPLICATION

This application claims the priority, under 35 U.S.C. §119, of German patent applications DE 10 2011 100 324.3, filed May 4, 2011, and DE 10 2011 118 537.6, filed Nov. 15, 2011; the prior applications are herewith incorporated by reference in their entirety.

BACKGROUND OF THE INVENTION

Field of the Invention

The invention relates to an internal combustion engine with at least one combustion chamber, from which exhaust gas can be discharged by way of at least one exhaust valve, comprising an engine braking device having a hydraulic additional valve control unit, which is integrated into a connecting mechanism connecting the exhaust valve to a camshaft and which holds the exhaust valve in a partially opened position when the engine braking device is actuated, and comprising a hydraulic valve lash compensating mechanism for the exhaust valve, wherein the connecting mechanism comprises at least one rocker lever and an intermediate element arranged between the rocker lever and the exhaust valve, and wherein the hydraulic additional valve control unit of the engine braking device comprises a first piston-cylinder unit for the temporary partial opening of one exhaust valve, and the hydraulic valve lash compensating mechanism comprises a second piston-cylinder unit for counteracting valve lash.

United States Patent Application Publication US 2010/0319657 A1 describes a method and a system with an EVB (Exhaust Valve Brake), in which braking energy of the engine is produced by combining an engine exhaust brake and a decompression brake. For this purpose, US 2010/0319657 A1 provides for two exhaust valves to be activated on one valve bridge, one of the exhaust valves being mounted on the valve bridge in such a way that it can be moved and controlled by a piston-cylinder unit. This first piston-cylinder unit in the valve bridge ensures that an open position of the linear-motion exhaust valve of the valve bridge can be implemented and held and hence ensures the possibility of braking.

The valve bridge furthermore comprises a second piston-cylinder unit, which serves as a means of connection to the valve-side arm of the rocker lever, the rocker lever being put under a preload by a spring on the upper side of the rocker lever arm. Moreover, the camshaft is provided with a larger main exhaust lobe and a smaller compression reduction lobe. With each rotation of the camshaft, irrespective of whether a braking operation has been initiated, the rocker lever responds to both lobes of the camshaft. By means of an oil carrying duct extending from the center of the rocker lever, via the connecting elements, to the second piston-cylinder unit and, from the latter, to the first piston-cylinder unit, the system is supplied during the braking phase with an oil pressure which has a controlling effect on the elements connected to the duct. Via an outlet opening in the valve bridge, which is closed in phases by a counterholder, the oil or oil pressure trapped in the valve bridge can escape or can be relieved at certain times (as the large lobe is traversed).

The disadvantage with this system is that, on the one hand, it requires active control, namely a supply of oil pressure in order to open the exhaust valve and keep it open for the braking action of the engine. The buildup of an oil pressure within the rocker lever, the valve bridge and the parts connecting them is fundamentally problematic since the tolerances and, in particular, the leaktightness of the abovementioned elements with respect to one another can vary greatly during the use of this system, and this can have a direct effect on the reliability of the pressure buildup and hence on the controllability of the outlet opening. It is furthermore disadvantageous that the overall system always traverses both lobes. The movement of the compression reduction lobe in the non-braking condition represents an unnecessary expenditure of energy and increases wear on the overall system.

Another disadvantage may be seen in the fact that the performance of the first piston-cylinder unit is likewise directly impaired in the event of a fault in the piston-cylinder unit required for valve lash compensation, since the oil carrying duct passes through several elements in series.

SUMMARY OF THE INVENTION

It is accordingly an object of the invention to provide an internal combustion engine which overcome the above-mentioned disadvantages of the heretofore-known devices and methods of this general type and which provides for an internal combustion engine and a related operating method such that valve lash compensation and, at the same time, a combined engine exhaust brake and decompression brake (EVB) can be implemented in a simple and reliable manner. It is furthermore the object of the invention to configure the system in such a way that it is easy to manufacture and is subject to little wear, and that the movements performed by the elements are small and subject to little frictional resistance. It is a further object of the invention to provide for a passively controlled EVB which manages without an actively operating electronic/electric or hydraulic control line.

With the foregoing and other objects in view there is provided, in accordance with the invention, an internal combustion engine formed with at least one combustion chamber in which exhaust gas is produced and the exhaust gas is discharged by way of at least one exhaust valve. The assembly comprising:

- an engine braking device having an hydraulic additional valve control unit integrated into a connecting mechanism connecting the exhaust valve to a camshaft and configured to hold the exhaust valve in a partially opened position when the engine braking device is actuated;
- an hydraulic valve lash compensating mechanism for the exhaust valve;
- the connecting mechanism including at least one rocker lever and an intermediate element arranged between the rocker lever and the exhaust valve;
- the hydraulic additional valve control unit of the engine braking device including a first piston-cylinder unit for a temporary partial opening of one exhaust valve, the first piston-cylinder unit being disposed in or on the intermediate element; and
- the hydraulic valve lash compensating mechanism including a second piston-cylinder unit for counteracting valve lash, the second piston-cylinder unit being disposed in or on the rocker lever.

A crucial aspect of the invention is considered to be the fact that the first piston-cylinder unit is arranged in or on the intermediate element, and the second piston-cylinder unit is arranged in or on the rocker lever. Arranging the first and the second piston-cylinder unit in or on two separate elements of the connecting mechanism is a simple way of enabling a delay in the response of the two piston-cylinder units relative to one another to be achieved. Another crucial aspect of the invention is that of exploiting and designing for this delay in the response of the two piston-cylinder units relative to one another in such a way that unwanted effects of one piston-cylinder unit on the other piston-cylinder unit can be significantly minimized and/or completely eliminated.

This is because the intermediate element, generally including a valve bridge, is not rigidly connected to the rocker lever and a gap could arise if the valves were to perform a rapid movement toward the combustion chamber. Such a gap would lead to the possibility of a portion of the movement of the rocker lever, even if only small, having no direct effect on the intermediate element. During this portion of the movement, inertia forces can exert a delaying effect on the movement and/or acceleration of the rocker lever. If the rocker lever is acted upon by a force which imposes upon it a rotary motion, this motion is performed only with a delay or with a delayed acceleration since the mass of the rocker lever has an effect. In the case of a valve jump, for example, a positive use may be made of this effect since the restoring force of the hydraulic valve lash compensation (by the second piston-cylinder unit) can for this reason take effect to only a limited extent on a possible unwanted adjusting movement of the rocker lever in the direction of the valves. This can lead to the introduction of force taking effect on the rocker lever and the movement/acceleration thereof with a delay such that the second piston-cylinder unit arranged on the rocker lever does not respond directly and hence responds with a delay, and thus that an unwanted movement and/or acceleration of the second piston-cylinder unit can be prevented or can thereby be minimized at least to the extent that there is only an insignificant effect on the overall system.

According to a preferred embodiment, the first and the second piston-cylinder unit are connected for oil supply to a common oil source, and the first and the second piston-cylinder unit are each connected to the oil source without the other piston-cylinder unit lying in between. The valve gear or the connecting mechanism is fed by an oil feed present on the bearing of the rocker lever, for example. The oil provided there at a substantially constant pressure is directed via oil ducts both to the first and the second piston-cylinder unit and to bearing locations of movably mounted parts. The advantage of this design measure is that the first and the second piston-cylinder unit are supplied with oil pressure independently of one another, thus ensuring that, if there is a fault in one of the two piston-cylinder units, the other is not affected in its operation and/or control.

The decoupling of the oil ducts leading to the first and the second piston-cylinder unit additionally assists the delayed, decoupled and hence also more independent operation of the respective piston-cylinder unit.

In a particularly preferred embodiment, the rocker lever has at least two arms enclosing an angle. In a first variant of this embodiment, the second piston-cylinder unit can be arranged in or on the arm of the rocker lever which is adjacent to the camshaft. In an alternative variant, the second piston-cylinder unit arranged in or on one arm of the rocker lever is arranged between a rocker lever bearing and the intermediate element or valve bridge, preferably with a further rocker lever element capable of separate movement in between.

The first-mentioned variant is distinguished by the fact that the arrangement of the second piston-cylinder unit on the arm of the rocker lever situated opposite the valve bridge reinforces the effect of inertia on the movement of the rocker lever. With the second variant, it is possible to achieve a series connection of the oil supply of the first and the second piston-cylinder unit. In the case of embodiments in which the rocker lever is formed by a plurality of parts capable of moving relative to one another too, arrangement of the second piston-cylinder unit between the rocker lever bearing and the intermediate elements or on the side associated with the intermediate element (e.g. the valve bridge), starting from the rocker lever bearing, can be advantageous.

As an essential component, the intermediate element can comprise a valve bridge, which connects at least two exhaust valves to one another. The intermediate element can furthermore also comprise connecting members between the rocker lever and the exhaust valve. In the description below, reference will be made to embodiments in which the intermediate element is designed as a valve bridge.

In EVB systems, a distinction can be drawn between active and passive systems, the active systems using either direct electronic/electric control of an exhaust valve to move the exhaust valve into a partially opened position, or initiate this by means of a control circuit operating at an oil pressure which can be controlled in a defined manner. The passive systems, in contrast, are distinguished by the fact that the partially opened position of the exhaust valve is initiated by a backflow of exhaust gas backed up in the exhaust duct or that the exhaust valve is stopped in an intermediate position in the closing movement thereof. In this case, the braking action of the engine is achieved by closing a flap in the exhaust duct, and the exhaust gas backing up from there builds up a back-pressure which counteracts the closure of the exhaust valve, which is mounted for linear motion in the valve bridge. The exhaust valve is held open by the blocking action of the first piston-cylinder unit.

Another significant advantage in the embodiment underlying the inventive concept can be achieved if the rocker lever is of multi-part construction and comprises a main body and a carrier body, wherein the carrier body is mounted in such a way as to be movable relative to the main body and wherein the relative mobility of the main body and the carrier body can be influenced by means of the second piston-cylinder unit. By virtue of the fact that the second piston-cylinder unit is supplied with an oil pressure, a preloading force can act between the two levers, thus making it possible to perform hydraulic valve lash compensation through the relative motion of the main body and the carrier body. As an alternative or in addition, a correspondingly preloaded spring can apply the restoring force.

The second piston-cylinder unit is preferably designed in the manner of a one-way valve and embodied with a preloading effect toward the camshaft with respect to the carrier body, wherein, in a blocking phase, the second piston-cylinder unit ensures a substantially rigid connection between the rocker lever and the camshaft. During an adjustment phase, an inward deflection is preferably performed. The second piston-cylinder unit forms an essential component of the hydraulic valve lash compensator and ensures that a gap between the contact area of the carrier body (e.g. a roller) and the camshaft resulting from wear or other circumstances reliably remains closed or does not form thanks to adjustment of the second piston-cylinder unit.

The method according to the invention is preferably used on an engine with an overhead camshaft.

However, despite hydraulic valve lash compensation, the basic operation of the rocker lever should be ensured, in which the rocker lever performs a defined rocking movement as it runs over the cam, for which purpose the rocker lever has a certain intrinsic rigidity, which is exercised at least during the blocking phase. Despite the virtually rigid connection of the main body and the carrier body owing to the second piston-cylinder unit, a slight inward deflection of the second piston-cylinder unit as the cam is traversed is performed or willingly accepted. Care should be taken here to ensure that the design of the components which respond to the rocking movement of the rocker lever allows for this slight inward deflection of the second piston-cylinder unit as the cam is traversed. The slight inward deflection as the cam is traversed and the subsequent return of the second piston-cylinder unit owing to a restoring spring arranged in the second piston-cylinder unit and/or by the oil pressure prevailing in the second piston-cylinder unit allows self-compensation of the system, with the result that, if there is overadjustment by the second piston-cylinder unit to avoid a gap, this gap can be returned to a "normal size" after the cam of the camshaft has been traversed. Increased stresses in the connecting mechanism are thereby avoided.

It is furthermore proposed that the pivot of a carrier body capable of rotary motion be aligned concentrically with the pivot of the rocker lever. The fact that the two pivot points coincide means that fewer bearing elements are required and a compact construction is made possible.

It is furthermore advantageous if a contact element in contact with the camshaft is arranged on the carrier body or mounted movably on the carrier body, wherein the contact element is preferably designed as a roller rotatably mounted on the carrier body. The carrier body thus acts as a carrier for the contact element, which is designed as a roller, and allows a movement of the contact element in response to the movement of the camshaft.

For its part, the carrier body is mounted movably on the main body or parallel to the latter on a rocker lever pivot, for example. If the carrier body is mounted movably on the main body, this can be accomplished either by means of a pivot bearing, which allows a rotary motion of the carrier body relative to the main body or by means of a linear bearing, which allows a linear motion of the carrier body relative to the main body. In the case of a carrier body mounted rotatably on the main body, it is advantageous if the longitudinal axis of the second piston-cylinder unit encloses an angle of 45° to −45° with a reference line drawn from a point in the retracted end position of the second piston-cylinder unit to the center of the axis of rotation of the camshaft and/or to the center of the axis of rotation of a rotatably mounted contact element. In the case of a carrier body mounted for linear motion, it is advantageous if the longitudinal axis of the second piston-cylinder unit encloses an angle of 45° to −45° with the longitudinal axis of the linear motion of the carrier body or is aligned parallel therewith. In particular, it is advantageous if the angular range is from 20° to −20°, particularly preferably from 10° to −10°, both for the carrier body capable of rotary motion and for the carrier body capable of linear motion. The closer the angle approaches to 0° or to the parallel alignment of the two longitudinal axes, the better is the efficiency with which the second piston-cylinder unit introduces force into the carrier element, thus ensuring that a lower oil pressure is required to implement the defined restoring force.

The first and the second piston-cylinder unit are preferably each provided with a piston preloaded by a spring, a pressure chamber, and a blocking element, which closes the pressure chamber, at least in phases. The blocking element and the pressure chamber enable these elements to be used as a blocking means by virtue of the oil temporarily trapped in the pressure chamber. By means of the blocking function of the second piston-cylinder unit, the ability of the carrier to move relative to the main body is to a large extent inhibited. The blocking function of the first piston-cylinder unit makes it possible to perform a holding function of the exhaust valve in a partially opened position.

The pressure chamber of the first piston-cylinder unit comprises an oil duct, which leads to the outside of the pressure chamber of the intermediate element and is closed in phases in a substantially oil-tight manner by a counterholder. The closing function of the counterholder with respect to the oil duct of the pressure chamber of the first piston-cylinder unit, said oil duct leading out of the intermediate element (e.g. the valve bridge), is active when the rocker lever is running on the base circle of the cam and the valve bridge thus remains in the closed valve position thereof. When the rocker lever then performs a rocking movement owing to traversing the cam, the valve bridge is thereby pushed downward, with the counterholder remaining in position as an element which is fixed relative to the fulcrum of the rocker lever, with the result that the oil duct leading out of the pressure chamber of the first piston-cylinder unit to the outside of the valve bridge is exposed, with the result that the oil pressure prevailing in the pressure chamber is relieved and the blocking function of the first piston-cylinder unit is canceled, and the exhaust valve controlled or connected in the first piston-cylinder unit is thus moved back into its closing end position by the spring force of the valve springs.

In principle, the system according to the invention can be used both in active and in passive EVBs. However, a particularly advantageous embodiment is achieved if the inventive concept underlying the main claim is used on a passive EVB and the engine braking effect is achieved by holding open an exhaust valve and/or not by an additional valve operating exclusively for the braking effect.

With the above and other objects in view there is also provided, in accordance with the invention, a method of operating an internal combustion engine having an hydraulic valve lash compensator and a combined engine exhaust and decompression brake. The method comprises:

- providing an internal combustion engine as outlined herein with a two-part rocker lever having a carrier body and a main body;
- enabling the carrier body and the main body to perform a relative movement with respect to one another in the case of valve lash compensation;
- on occasion of a brief movement of the exhaust valve, performing with the second piston-cylinder unit an insignificant movement, or no movement, of the carrier body relative to the main body owing to the arrangement of the second piston-cylinder unit in or on the rocker lever and/or owing to the inertia of a movement of the rocker lever.

In other words, the invention is also based on a method which, in order to operate an internal combustion engine having a hydraulic valve lash compensator and a combined engine exhaust and decompression brake, the internal combustion engine is provided with at least one rocker lever of two-part design, which comprises a carrier body and a main body, which perform a relative movement with respect to one another in the case of valve lash compensation, wherein, in the case of a brief movement of the valve and/or of the intermediate element, the second piston-cylinder unit performs an insignificant movement or no movement of the carrier body relative to the main body owing to the arrangement of said unit in or on the rocker lever and/or to the inertia of the rocker lever.

Other features which are considered as characteristic for the invention are set forth in the appended claims.

Although the invention is illustrated and described herein as embodied in an internal combustion engine having at least one combustion chamber, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings.

DETAILED DESCRIPTION OF THE INVENTION

Figure 1:
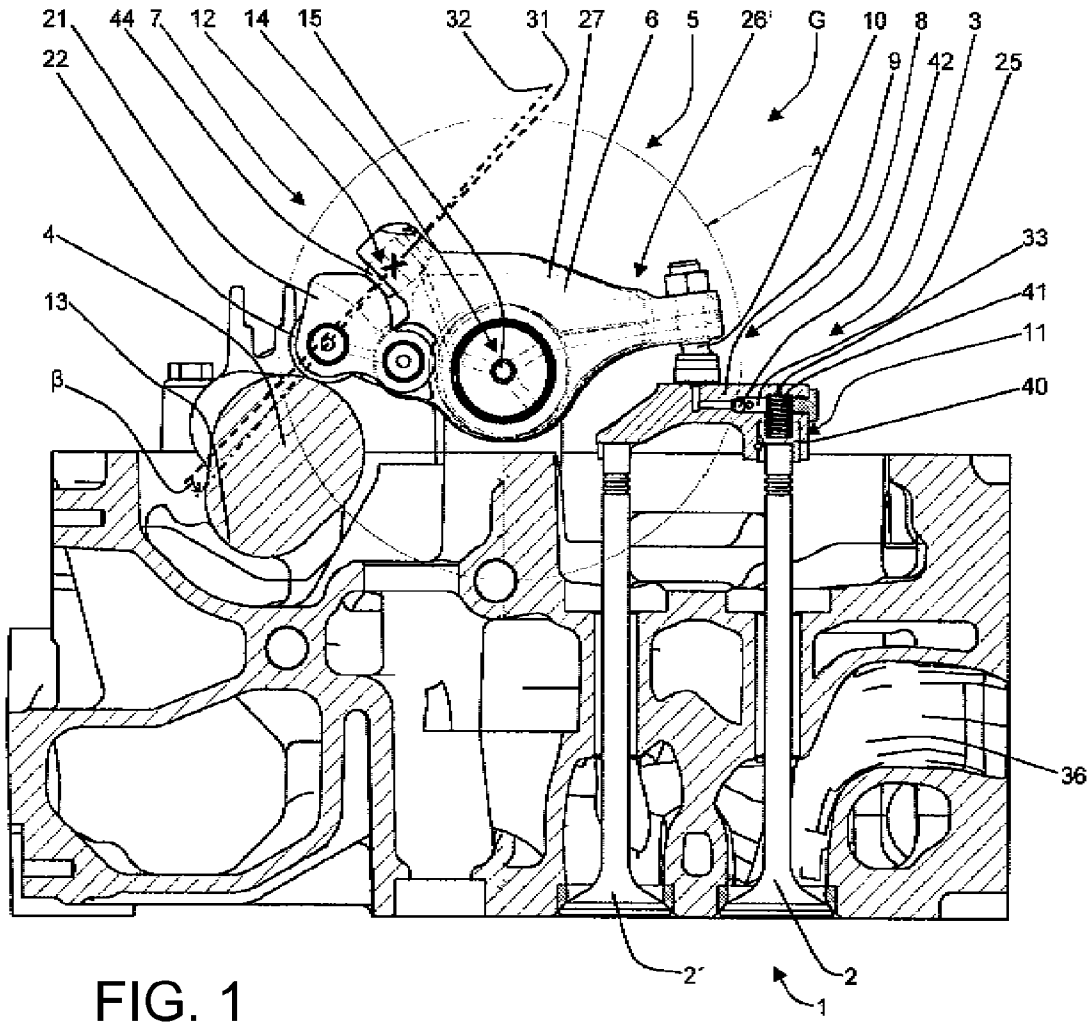
FIG. 1: shows a schematic section through part of an internal combustion engine, which is fitted with an engine braking device and a hydraulic valve lash compensating mechanism.

Referring now to the figures of the drawing in detail and first, particularly, to FIG. 1 thereof, there is shown a section illustrating the primarily important elements of the invention. An internal combustion engine is provided with at least one combustion chamber 1, from which exhaust gas can be discharged by means of at least one exhaust valve 2, 2', wherein the internal combustion engine is provided with an engine braking device having a hydraulic additional valve control unit 3. The hydraulic additional valve control unit 3 is integrated into a connecting mechanism 5 connecting the exhaust valve 2, 2' to a camshaft 4, wherein the exhaust valve 2 is held in a partially opened position Z when the engine braking device is actuated. The valves 2, 2' are moved backward and forward between a closed position S and an open position O by the response of the rocker lever 6 to the position of the camshaft 4. Only one of the exhaust valves 2, 2', namely exhaust valve 2, can be held, temporarily or during a braking phase, in a partially opened position Z by the additional valve control unit 3 in the case of a braking operation.

The internal combustion engine furthermore comprises a hydraulic valve lash compensating mechanism 7, by means of which any wear which arises in the course of wear phenomena on individual elements of the connecting mechanism 5 and hence lash (i.e., play) within the system is avoided by adjusting individual elements. The connecting mechanism 5 furthermore comprises a rocker lever 6 and an intermediate element 8 arranged between the rocker lever 6 and the exhaust valve 2, 2'. In the embodiment illustrated, the intermediate element 8 is designed as a valve bridge 9, which couples two exhaust valves 2, 2' to one another and is in contact with an adjusting screw 10 mounted adjustably on the rocker lever. The adjusting screw 10 is connected by a coupling element 29 to the valve bridge 9, and the coupling element 29 can be an integral component of the intermediate element 8 or an attached component of the intermediate element 8. In the embodiment illustrated, the coupling element 29 rests on the valve bridge 9 and can move away from the latter.

By means of the adjusting screw 10, a rocking movement of the rocker lever 6 is transmitted to the valve bridge 9 and hence to the exhaust valves 2, 2'. By means of this movement, control of the exhaust valves 2, 2' and defined movement thereof from a closed position S to an open position O and back again is achieved. The two valves 2, 2' are preloaded into the closed position S thereof by valve springs (not shown), and therefore a return movement can be performed after the return movement of the rocker lever. To implement the engine braking device, the hydraulic additional valve control unit 3 has a first piston-cylinder unit 11. The hydraulic valve lash compensating mechanism 7 comprises a second piston-cylinder unit 12, which counteracts the occurrence of valve lash.

In the illustrated embodiment, the first piston-cylinder unit 11 is arranged in the valve bridge 9, and the second piston-cylinder unit 12 is arranged in the rocker lever 6.

Figure 4:
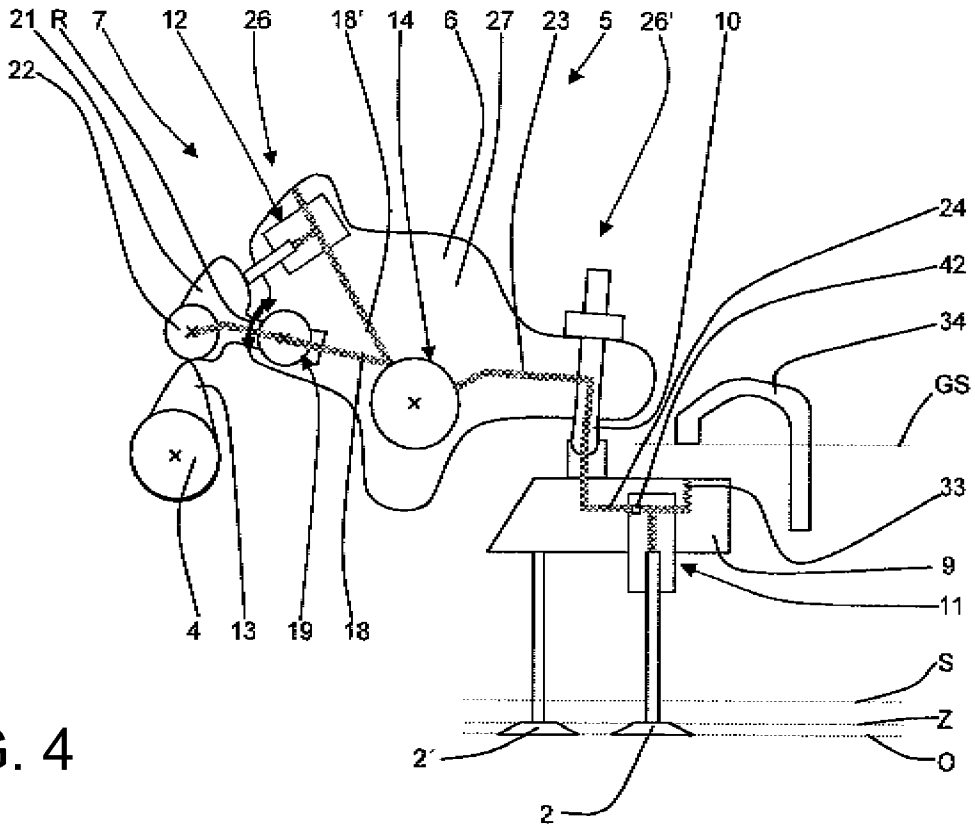
FIG. 4: shows a schematic illustration in accordance with FIG. 3, wherein the rocker lever roller is running on the cam and the valves are located in the open position.
Figure 5:
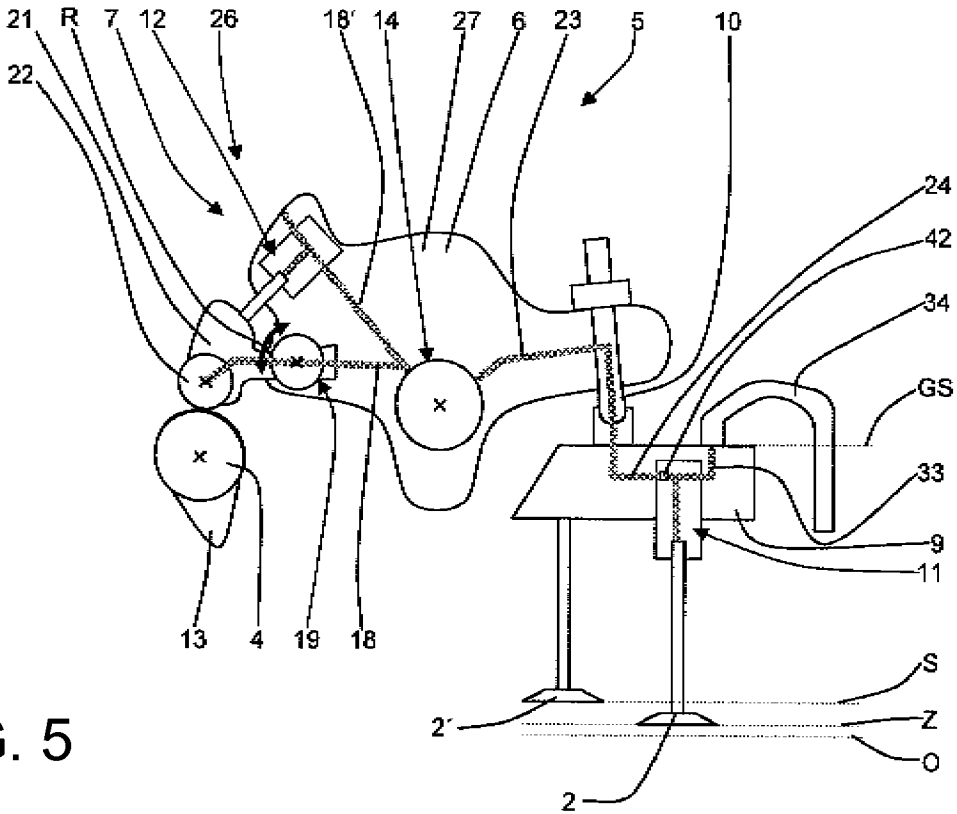
FIG. 5: shows a schematic illustration in accordance with FIG. 3, wherein the rocker lever roller is running on the cam base circle and one exhaust valve is arranged in a partially opened position (braking mode)
Figure 6:
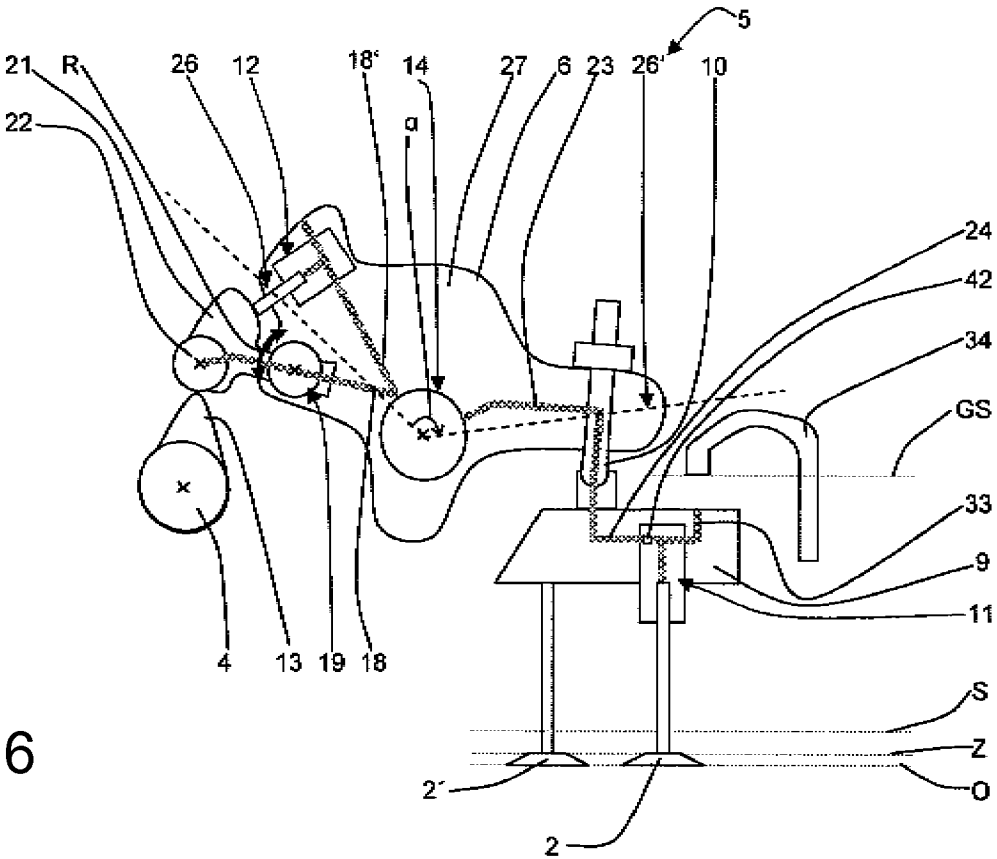
FIG. 6: shows a schematic illustration in accordance with FIG. 3, wherein the rocker lever roller is running on the cam of the camshaft and the two exhaust valves are arranged in the opened position.

In FIGS. 1, 2, 3, 5, 7, 8 and 9, the connecting mechanism 5 is in all cases aligned on the base circle of the camshaft 4 and hence in the initial position G thereof. In FIGS. 4 and 6, the connecting mechanism 5 has been moved out of the initial position G by the cam 13 of the camshaft 4 into a position which brings the valves 2, 2' into the open position O.

The first and the second piston-cylinder unit 11, 12 are connected for oil supply to a common oil source, here in the bearing area 14 of the rocker lever 6, wherein the first and the second piston-cylinder unit 11, 12 are each connected to the oil source without the other piston-cylinder unit 11, 12 lying in between. Starting from the bearing 14 of the rocker lever 6, oil is passed through an axial hole 15 to the center of the bearing 14 and, from there, is directed via duct sections 16, 16', 16" within the bearing 14 to the camshaft side of the rocker lever 6, to the valve bridge side of the rocker lever 6 and to lubricating areas 17 for lubricating the rotary motion of the rocker lever 6 relative to the bearing 14. Duct section 16 merges into oil ducts 18, 18', which carry the oil to bearing locations or to the pivots 19, 20 of a carrier body 21 and of a roller 22. Duct section 18', which is likewise arranged in the rocker lever 6, directs the oil to the second piston-cylinder unit 12. Duct section 16 carries the oil via a duct section 23 to the adjusting screw 10, within which is arranged an axial oil carrying hole (not shown) which, in turn, carries the oil to the valve bridge 9 and there, in an oil duct 24 arranged within the valve bridge 9, carries the oil to a pressure chamber 25 in the first piston-cylinder unit 11.

Figure 2:
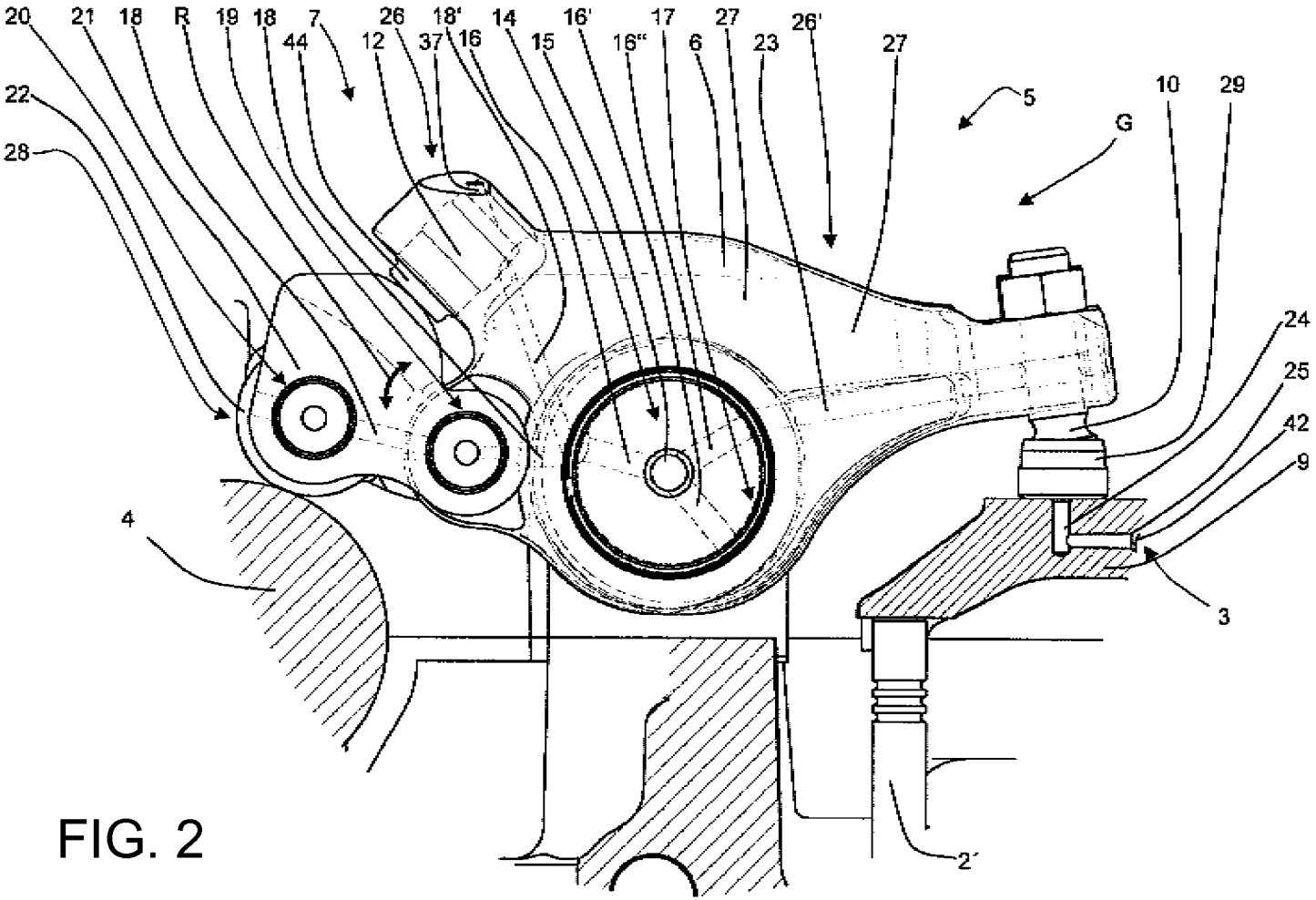
FIG. 2: shows a schematic section in accordance with the detail A in FIG. 1.
Figure 3:
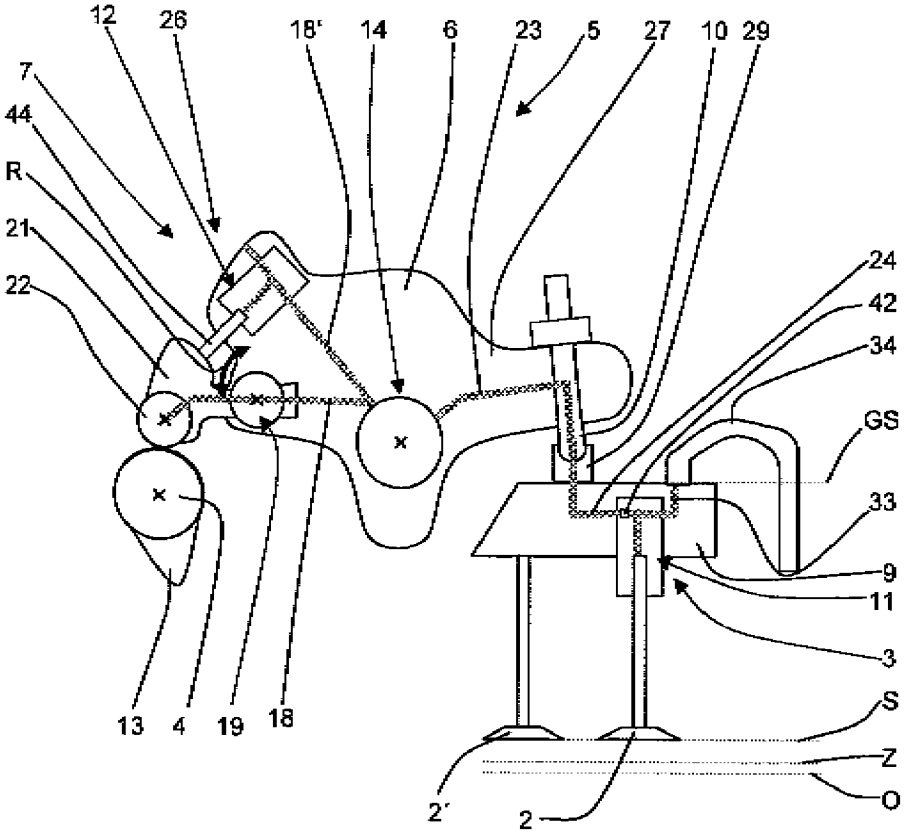
FIG. 3: shows a simplified schematic illustration of essential elements of the internal combustion engine with closed valves and a rocker lever roller on a cam base circle.
Figure 7:
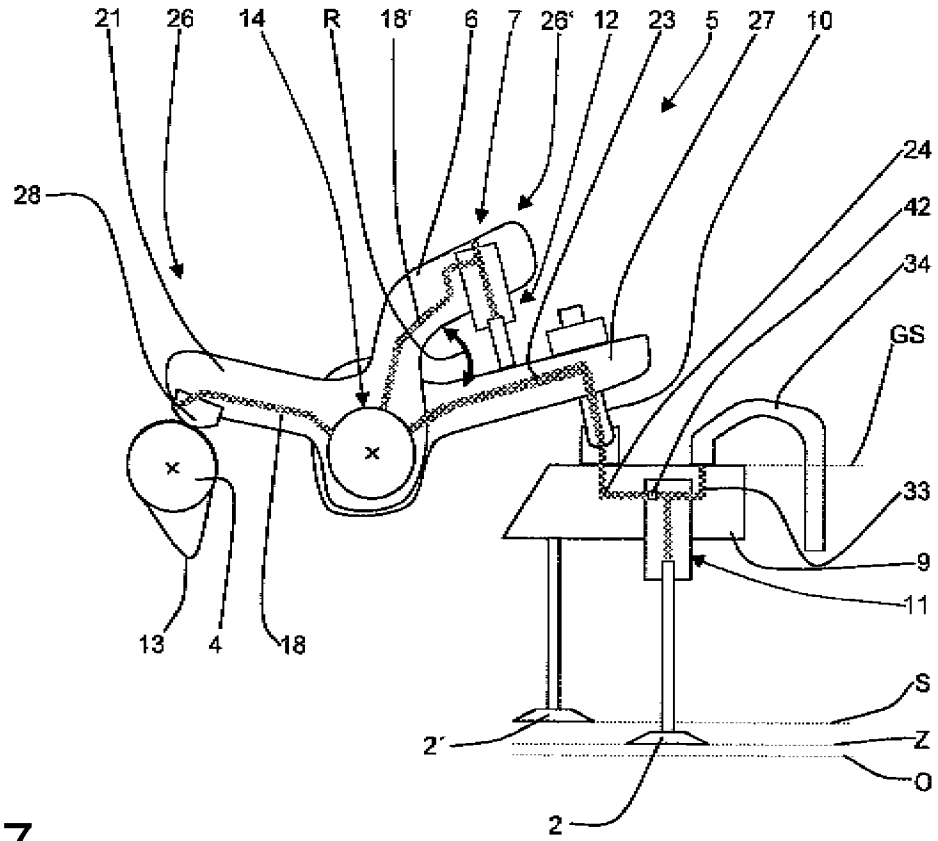
FIG. 7: shows a schematic illustration of an alternative embodiment of the connecting mechanism between the camshaft and the exhaust valves.
Figure 8:
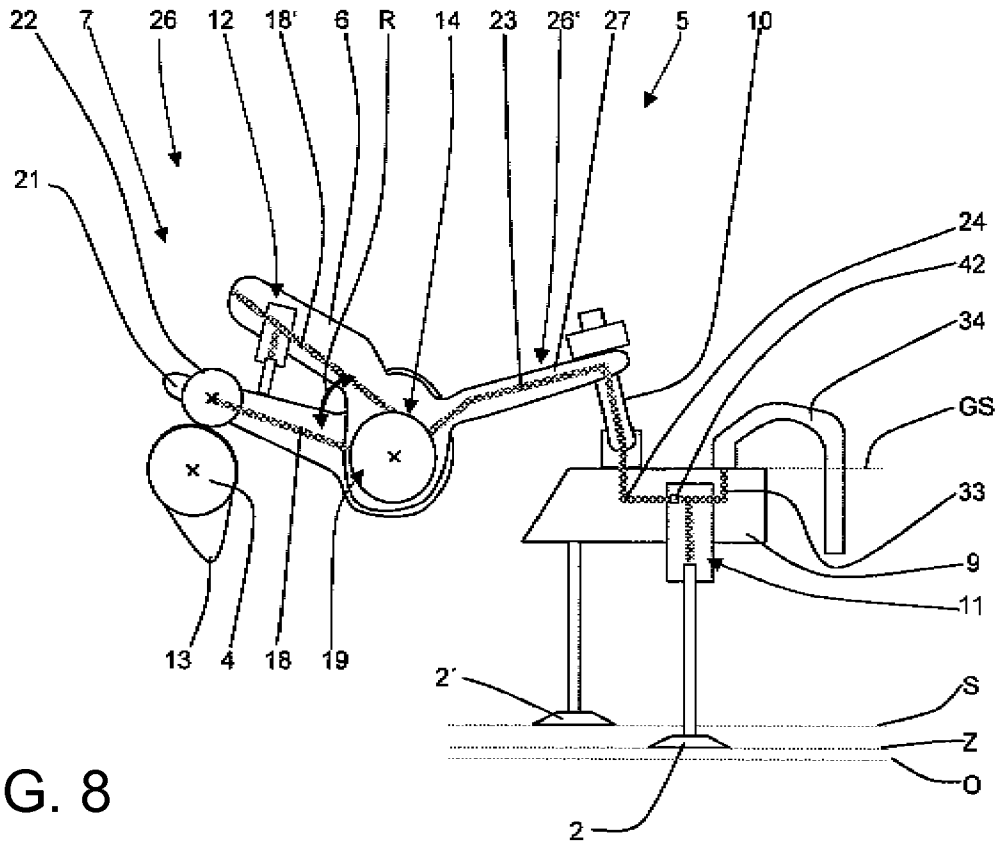
FIG. 8: shows a schematic illustration of another alternative embodiment, wherein the second piston-cylinder unit is arranged between the camshaft and the exhaust valve.

The rocker lever 6 is preferably provided with two arms 26, 26', which enclose an angle $\alpha$, wherein the second piston-cylinder unit 12 is arranged in the arm 26 of the rocker lever 6 which is adjacent to the camshaft 4, cf. FIG. 2. In an alternative embodiment, which is illustrated in FIG. 7 of the drawing, the second piston-cylinder unit 12 is arranged in arm 26' of the rocker lever 6, wherein the second piston-cylinder unit 12 is arranged in the region between a rocker lever bearing 14 and the valve bridge 9.

In the embodiment illustrated, the rocker lever 6 is of multi-part construction and comprises a main body 27 and a carrier body 21, wherein the carrier body 21 is mounted in such a way as to be rotatable relative to the main body 27, wherein the relative mobility (arrow R) of the main body 27 and the carrier body 21 can be influenced by means of the second piston-cylinder unit 12. The element of the rocker lever 6 which is defined as the main body 27 is the one which is mechanically closer to the valve bridge 9 or intermediate element 8. The carrier element 21 forms the carrier for the contact element 28, which is in contact with the camshaft 4. The contact element 28 can comprise a sliding element, cf. FIG. 7, or a roller 22. According to FIGS. 7 and 8 of the drawing, the pivot 29 of the carrier body 21 can be aligned concentrically with the pivot 14 of the main body 27 of the rocker lever 6.

According to FIGS. 1 to 6 of the drawing, the carrier body 21 is thus arranged rotatably on the main body 27 by way of pivot 19, wherein the rotary motion R of the carrier body 21 is influenced by the action of the second piston-cylinder unit 12, on the one hand, and by the contact with the camshaft 4 via the contact element 28 and/or the roller 22, on the other hand. When the camshaft 4 is rotated beyond the base circle, the roller 22 moves up the cam 13, while the second piston-cylinder unit 12 behaves substantially in a rigid manner—apart from a slight inward and outward deflection—and transmits the movement of the cam 13 to the rocker lever 6, with the result that the latter performs a rotary movement which, in turn, acts via the adjusting screw 10 on the valve bridge 9 and moves the latter in the direction of the combustion chamber 1 and hence moves the valves 2, 2' into an open position O. By means of this property of the second piston-cylinder unit 12, which essentially represents a blocking action, it is possible to ensure the customary functioning of a rocker lever 6. The substantially rigid property of the second piston-cylinder unit 12 can be achieved by virtue of the fact that said unit behaves essentially in the manner of a one-way valve.

As illustrated, in particular, by FIG. 1 of the drawing, it is advantageous if the longitudinal axis 31 of the second piston-cylinder unit 12 encloses an angle $\beta$ of 45° to −45°, in particular an angle $\beta$ of 10° to −10°, with a straight reference line 32 drawn between a point of the retracted end position (center of the cross section of the piston, marked by "x" in FIG. 1) of the second piston-cylinder unit 12 and the pivot 20 of the pivot bearing.

The construction of the first and/or of the second piston-cylinder unit 11, 12 in each case provides for a piston 40, 44 preloaded into the extended position, preferably by a spring 41, 45, a pressure chamber 25, 47, and a blocking element 42, 46, which closes the pressure chamber 25, 47, at least in phases. It is thus possible to implement a pressure chamber 25, 47 filled with oil and, given simultaneous closure of the pressure chamber 25, 47 by the blocking element 42, 46, to implement blocking of the movement of the first and/or second piston-cylinder unit 11, 12.

The pressure chamber 25 of the first piston-cylinder unit 11, said chamber being arranged in the valve bridge 9, furthermore provides an oil duct 33, which leads to the outside of the pressure chamber 25 and can be closed in phases by the counterholder 34. This closure continues at least while the valve bridge 9 remains in the initial position GS thereof. When the roller 22 runs onto the cam 13 of the camshaft 4, the valve bridge 9 is moved downward out of the initial position GS thereof by the rocking movement of the rocker lever 6, with the result that the positionally fixed counterholder 34 exposes the oil duct 33 and hence the pressure chamber 25, and the oil trapped therein can be forced out.

Figure 10:
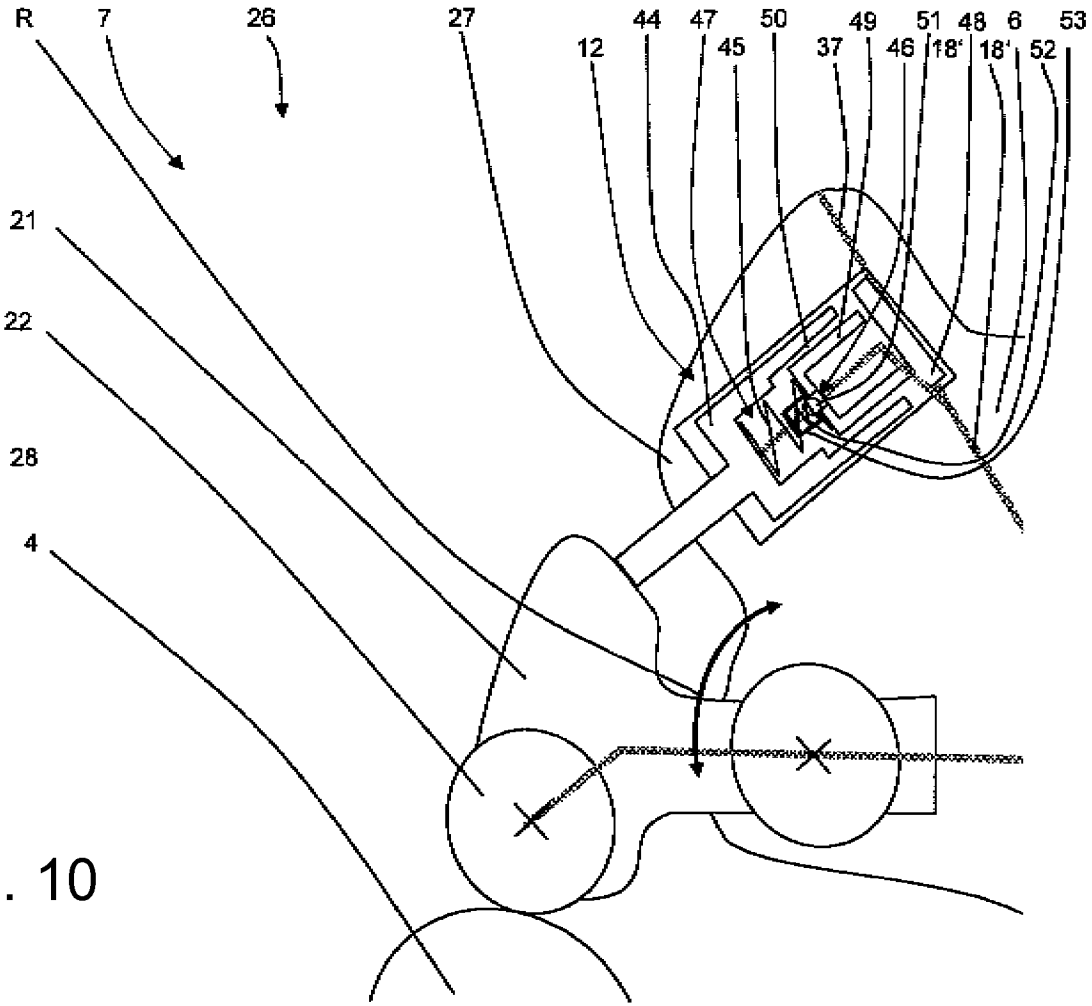
FIG. 10: shows a schematic detail of the second piston-cylinder unit.

As can be seen from FIG. 10, the second piston-cylinder unit 12 comprises a disk 48, on which a cylindrical supporting means 49, which has a through hole in the center of the bottom surface, is placed. A pressure chamber 47, which is connected to a pre-chamber by the through hole, is formed between the piston 44 and supporting means 49. The supporting means 49 is partially surrounded by an inner region of the piston 44. A step in the interengaging region serves as an end position limiter for the movement of the piston 44 relative to the supporting means 49. The through hole can be closed in phases by means of a ball 51, wherein a spring 52 preloads the ball 51 into the closed position thereof, for which purpose the spring 52 is supported against a cage 53. During the inward deflection of the second piston-cylinder unit, small quantities of the oil present in the pressure chamber 47 flow to the vent duct 37 through the interspace 50 between the piston 44 and the supporting means 49.

According to the invention, the second piston-cylinder unit 12 and the mounting 19 of the carrier body 21 relative to the main body 27 are arranged and designed in such a way that, in the case of brief movements of the valves 2, 2', the movement R of the carrier body 21 relative to the main body 27, which movement can be influenced by the second piston-cylinder unit 12, is performed to an insignificant extent or not at all, and this movement performed to an insignificant extent or not at all is preferably based essentially on the inertia of the rocker lever 6.

Figure 9:
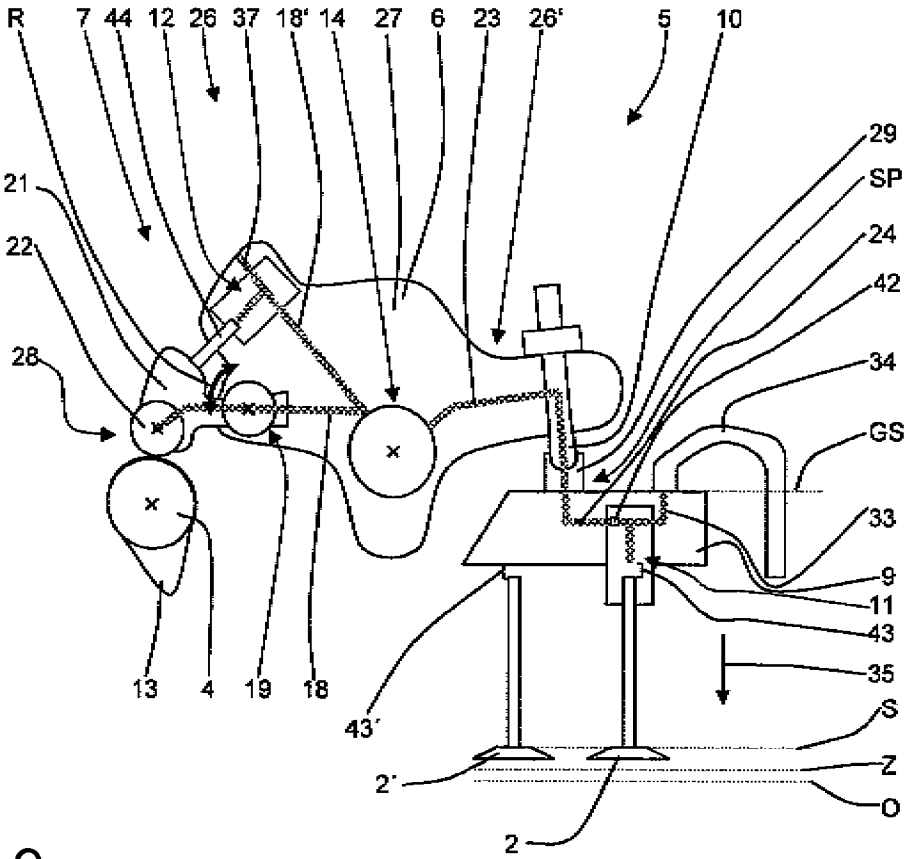
FIG. 9: shows a schematic illustration in accordance with FIG. 3, in which the valves are performing a valve jump.

Particularly in the case of a valve jump, which describes a brief movement 35 of the valves 2, 2', this inertia is essential, cf. FIG. 9. In FIG. 9, the valves 2, 2' are illustrated schematically at a distance 43, 43' from the valve bridge 9. When the valves 2, 2' are acted upon by the exhaust gas backed up in the exhaust pipe by an exhaust flap (not shown), for example, the valves 2, 2' can be acted upon by a force which initiates an abrupt movement 35 of the valves 2, 2'. Since the valves 2, 2' are moved away from the valve bridge 9 owing to this jumping motion, the valve bridge 9 is in a virtual "floating condition" since the abutment with the valves 2, 2' is lacking. In this situation, the valve bridge—like the valves 2, 2'—could likewise move in the direction of the combustion chamber 1 and away from the initial position GS. This would lead to the counterholder 34 opening the oil duct 33 and the impossibility of oil pressure building up in the pressure chamber 25 and, ultimately, there would be a blocking effect on the valve 2 in the partially opened position thereof.

An aggravating factor is that the second piston-cylinder unit 12, through its preloading of the carrier body 21 toward the camshaft 4, has the effect that the preloading force moves the rocker lever 6 in a direction (clockwise in FIG. 9) toward the valve side and would push the valve bridge 9 actively out of the initial position GS thereof. This exertion of influence by the second piston-cylinder unit 12 is unwanted. The inertia of the rocker lever 6, in particular that of the main body 27, can therefore be used to ensure that the effect of the second piston-cylinder unit 12 on the acceleration of the rocker lever 6, in particular of the main body 27, is performed in such a "delayed" manner that "pushing" of the valve bridge by the second piston-cylinder unit 12 does not occur or takes place only to an extent which is insignificant for the overall process. Since the first piston-cylinder unit 11 extends during the valve jump and the consequently expanding volume of the pressure chamber fills with oil from the oil duct 23, 24, an oil pressure forms in the pressure chamber 25, giving the valve bridge 9 a "hold" and pushing the latter into the initial position GS and hence against the counterholder 34.

The distance 43 or travel of the valve 2 from the valve bridge 9 should be ensured by means of the possible extension travel reserved for the piston 40 within the cylinder of the first piston-cylinder unit 11. The spring 41 is used to ensure a rapid response by the first piston-cylinder unit 11, this in turn allowing rapid filling of the pressure chamber 25, which is enlarged by the movement of the piston. As a result, the first piston-cylinder unit 11 responds more quickly with the effect of the blocking action due to the filling of the pressure chamber 25 and the blocking thereof by the blocking element 42 than the second piston-cylinder unit 12 with the transmission of the preload and the application of force to the valve bridge 9 and hence with the movement of the valve bridge 9 toward the combustion chamber 1.

As an alternative and/or in addition to the allowance for the mass of the rocker lever 6 and the associated delayed acceleration of the rocker lever 6, provision can be made to design the bearing area of the pivot 19 of the carrier element 21 relative to the main body 27 and/or the mounting of the rocker lever 6 on the rocker lever bearing 14 thereof in such a way that an increased static friction imparts an inertia to the rocker lever 6 and to the capacity for acceleration thereof, with the result that the second piston-cylinder unit 12 cannot close a (brief) gap 43, 43' between the valve bridge 9 and the valves 2, 2' by moving the valve bridge 9, or can do so only to an insignificant extent. In the course of the valve jump, there may be nonuniform and/or non-synchronous movement of the valves 2, 2' relative to the valve bridge 9. In addition, the valve bridge could briefly move into an oblique position during this process.

It is furthermore apparent from FIG. 2 that the first arm 26 of the rocker lever 6, that adjacent to the camshaft 4, and the second arm 26' of the rocker lever 6, that adjacent to the exhaust valve 2, 2', are each provided with at least one oil carrying duct 18', 23, wherein the oil carrying ducts 18', 23 are connected to the oil source (in this case hole 15), and, starting from the oil source, which is arranged in the region of the rocker lever bearing 14, the oil can be fed to the first and to the second piston-cylinder unit 11, 12 via the oil carrying ducts 18', 23. In the embodiment illustrated, a further oil carrying duct 18 is arranged in the first arm 26 in addition thereto, said duct directing the oil to the bearing area 19 of the carrier body 21 and, via duct sections in the carrier body 21, via the latter to the bearing area 20 of the contact element 28. A vent duct 37 is provided on oil carrying duct 18' and/or on the second piston-cylinder unit 12, said vent duct releasing a small proportion of oil to the surroundings of the rocker lever 6 in the case where the second piston-cylinder unit 12 is deflected inward, for example. In addition or as an alternative, air can escape through the duct 37 in the rocker lever 6.

The above-described arrangement according to the invention of the first and the second piston-cylinder unit 11, 12 is advantageous particularly for engines with an overhead camshaft 4.

The following list contains the reference numerals and identification labels used in the specification above:

1 combustion chamber
2, 2' exhaust valve
3 additional valve control unit
4 camshaft
5 connecting mechanism
6 rocker lever
7 valve lash compensating mechanism
8 intermediate element
9 valve bridge
10 adjusting screw
11 first piston-cylinder unit
12 second piston-cylinder unit
13 cam of 4
14 bearing of 6
15 hole
16, 16', 16" duct section
17 lubricating area
18, 18' duct section
9 pivot of 21
20 pivot of 22
21 carrier body for 22, 28
22 roller
23 duct section of 26
24 oil duct
25 pressure chamber of 11
26, 26' arm of 6
27 main body of 6
28 contact element
29 coupling element
31 longitudinal axis of 12
32 reference line
33 oil duct of 8
34 counterholder
35 movement
36 exhaust duct
37 vent duct
40 piston of 11
41 spring of 11
42 blocking element of 11
43, 43' distance between 2, 2' and 9
44 piston of 12
45 spring of 12
46 blocking element of 12
47 pressure chamber of 12
48 disk
49 supporting means
50 interspace
51 ball of 46
52 spring of 46
53 cage of 46
$\alpha$ angle between 26 and 26'
$\beta$ angle between 31 and 32
R movement between 21 and 27
S closed position of 2, 2'
O open position of 2, 2'
Z partially open position of 2
G initial position of 6
GS initial position of 9

The invention claimed is:

1. An internal combustion engine formed with at least one combustion chamber in which exhaust gas is produced and the exhaust gas is discharged by way of at least one exhaust valve, comprising:

an engine braking device having a hydraulic additional valve control unit integrated into a connecting mechanism connecting the exhaust valve to a camshaft and configured to hold the exhaust valve in a partially opened position when the engine braking device is actuated;

a hydraulic valve lash compensating mechanism for the exhaust valve;

said connecting mechanism including at least one rocker lever and an intermediate element arranged between said rocker lever and the exhaust valve;

said hydraulic additional valve control unit of said engine braking device including a first piston-cylinder unit for a temporary partial opening of one exhaust valve, said first piston-cylinder unit being disposed in or on said intermediate element;

said hydraulic valve lash compensating mechanism including a second piston-cylinder unit for counteracting valve lash, said second piston-cylinder unit being disposed in or on said rocker lever; and wherein said first piston-cylinder unit and said second piston-cylinder unit are connected for oil supply to a common oil source, and said first and second piston-cylinder units are each connected to said oil source without the respectively other piston-cylinder unit lying in between.

2. The internal combustion engine according to claim 1, wherein said intermediate element is a valve bridge connecting at least two exhaust valves to one another.

3. The internal combustion engine according to claim 1, wherein each of said first and second piston-cylinder units comprises a piston preloaded by a spring, a pressure chamber, and a blocking element configured to close said pressure chamber at least in phases.

4. The internal combustion engine according to claim 3, wherein said pressure chamber of said first piston-cylinder unit is formed with an oil duct leading to an outside of said pressure chamber of said intermediate element and is closable in phases by a counterholder.

5. The internal combustion engine according to claim 1, wherein said second piston-cylinder unit in or on said rocker lever and/or the mounting of said carrier body relative to said main body is or are configured such that, in case of temporally brief movements of the exhaust valves, a movement of said carrier body relative to said main body, which movement can be influenced by the second piston-cylinder unit, is substantially not performed.

6. The internal combustion engine according to claim 5, wherein the movement that is substantially not performed is based substantially on an inertia of said rocker lever.

7. The internal combustion engine according to claim 5, wherein a first arm of said main body of said rocker lever adjacent the camshaft; and a second arm of said main body of said rocker lever adjacent the exhaust valve;

are each provided with at least one oil carrying duct and said oil carrying ducts are connected to an oil source arranged in a region of a rocker lever bearing; and starting from said oil source, oil may be fed to said first and second piston-cylinder units via said oil carrying ducts.

8. A method of operating an internal combustion engine having an hydraulic valve lash compensator and a combined engine exhaust and decompression brake, the method which comprises:

providing an internal combustion engine according to claim 1 with a two-part rocker lever having a carrier body and a main body;

enabling the carrier body and the main body to perform a relative movement with respect to one another in the case of valve lash compensation;

wherein if the exhaust valve moves only briefly, performing with the second piston-cylinder unit an insignificant movement, or no movement at all.

9. An internal combustion engine formed with at least one combustion chamber in which exhaust gas is produced and the exhaust gas is discharged by way of at least one exhaust valve, comprising:

an engine braking device having a hydraulic additional valve control unit integrated into a connecting mechanism connecting the exhaust valve to a camshaft and configured to hold the exhaust valve in a partially opened position when the engine braking device is actuated;

a hydraulic valve lash compensating mechanism for the exhaust valve;

said connecting mechanism including at least one rocker lever and an intermediate element arranged between said rocker lever and the exhaust valve;

said hydraulic additional valve control unit of said engine braking device including a first piston-cylinder unit for a temporary partial opening of one exhaust valve, said first piston-cylinder unit being disposed in or on said intermediate element; and said hydraulic valve lash compensating mechanism including a second piston-cylinder unit for counteracting valve lash, said second piston-cylinder unit being disposed in or on said rocker lever, wherein:

said rocker lever comprises at least two arms enclosing therebetween an angle $\alpha$; and said second piston-cylinder unit is arranged in or on the arm of said rocker lever that is adjacent to the camshaft; or said second piston-cylinder unit in or on the arm of said rocker lever is arranged between a rocker lever bearing and said intermediate element.

10. An internal combustion engine formed with at least one combustion chamber in which exhaust gas is produced and the exhaust gas is discharged by way of at least one exhaust valve, comprising:

an engine braking device having a hydraulic additional valve control unit integrated into a connecting mechanism connecting the exhaust valve to a camshaft and configured to hold the exhaust valve in a partially opened position when the engine braking device is actuated;

a hydraulic valve lash compensating mechanism for the exhaust valve;

said connecting mechanism including at least one rocker lever and an intermediate element arranged between said rocker lever and the exhaust valve;

said hydraulic additional valve control unit of said engine braking device including a first piston-cylinder unit for a temporary partial opening of one exhaust valve, said first piston-cylinder unit being disposed in or on said intermediate element; and said hydraulic valve lash compensating mechanism including a second piston-cylinder unit for counteracting valve lash, said second piston-cylinder unit being disposed in or on said rocker lever;

wherein said rocker lever is a multi-part rocker lever having a main body and a carrier body, wherein said carrier body is mounted so as to be movable relative to said main body and wherein a relative mobility of said main body and said carrier body can be influenced by way of said second piston-cylinder unit.

11. The internal combustion engine according to claim 10, wherein a pivot of said carrier body is aligned concentrically with a pivot of said main body of said rocker lever.

12. The internal combustion engine according to claim 10, wherein said second piston-cylinder unit is configured to effect a preloading of said carrier body toward said camshaft, wherein, in a blocking phase, said second piston-cylinder unit ensures a substantially rigid connection between said rocker lever and said camshaft, wherein an inward deflection may optionally be performed during an adjustment phase.

13. The internal combustion engine according to claim 10, which comprises a contact element in contact with the camshaft and movably disposed on said carrier body.

14. The internal combustion engine according to claim 13, wherein said contact element is a roller rotatably mounted on said carrier body.

15. The internal combustion engine according to claim 10, which comprises a pivot bearing rotatably mounting said carrier body on said main body, and wherein a longitudinal axis of said second piston-cylinder unit encloses an angle β of 45° to −45° with a reference line extending between an end bearing point of the retracted said second piston-cylinder unit and a center of an axis of rotation of said pivot bearing, or wherein said carrier body is mounted for linear motion and the longitudinal axis of said second piston-cylinder unit encloses an angle β of 45° to −45° with a longitudinal axis of a linear motion of said carrier body or is aligned parallel therewith.

16. An internal combustion engine formed with at least one combustion chamber in which exhaust gas is produced and the exhaust gas is discharged by way of at least one exhaust valve, comprising:

an engine braking device having a hydraulic additional valve control unit integrated into a connecting mechanism connecting the exhaust valve to a camshaft and configured to hold the exhaust valve in a partially opened position when the engine braking device is actuated;

a hydraulic valve lash compensating mechanism for the exhaust valve;

said connecting mechanism including at least one rocker lever and an intermediate element arranged between said rocker lever and the exhaust valve;

said hydraulic additional valve control unit of said engine braking device including a first piston-cylinder unit for a temporary partial opening of one exhaust valve, said first piston-cylinder unit being disposed in or on said intermediate element; and said hydraulic valve lash compensating mechanism including a second piston-cylinder unit for counteracting valve lash, said second piston-cylinder unit being disposed in or on said rocker lever;

wherein said hydraulic additional valve control unit is configured such that the partially opened position of the exhaust valve is initiated by a stream of exhaust gas backed up in an exhaust duct, and/or wherein the partially opened position of the exhaust valve is initiated by a second control oil circuit connected to act on said hydraulic additional valve control unit.

* * * * *